US007574753B1

(12) United States Patent
Seyfried

(10) Patent No.: US 7,574,753 B1
(45) Date of Patent: Aug. 18, 2009

(54) GARTER FOR ITEMS OF APPAREL AND METHOD OF USE

(76) Inventor: Colette Seyfried, 2037 E. 34th St., Brooklyn, NY (US) 11234

( * ) Notice: Subject to any disclaimer, the term of this patent is extended or adjusted under 35 U.S.C. 154(b) by 300 days.

(21) Appl. No.: 11/374,515

(22) Filed: Mar. 13, 2006

Related U.S. Application Data

(63) Continuation-in-part of application No. 10/789,713, filed on Feb. 27, 2004, now abandoned.

(51) Int. Cl.
*A41F 9/00* (2006.01)
*A42F 19/00* (2006.01)

(52) U.S. Cl. ..... 2/312; 2/311; 2/313

(58) Field of Classification Search ..... 2/311, 2/312, 336, 338, 244, 246, 231–233, 321, 2/322, 335, 337, 170, 125, 113–115, 69, 2/126, 920, DIG. 11; 24/306, 442; 132/248
See application file for complete search history.

(56) References Cited

U.S. PATENT DOCUMENTS

| | | | | |
|---|---|---|---|---|
| 1,683,691 | A | | 9/1928 | Mulock |
| 2,691,172 | A | | 10/1954 | Breslow |
| 4,525,879 | A | | 7/1985 | Kalomeris |
| 4,825,475 | A | | 5/1989 | Smart |
| 5,567,038 | A | * | 10/1996 | Lary ..... 362/106 |
| 5,787,511 | A | | 8/1998 | Garside |
| 5,794,769 | A | | 8/1998 | Tomlinson et al. |
| 6,081,925 | A | | 7/2000 | Reiber |
| 6,158,057 | A | | 12/2000 | Neumann |
| 6,175,961 | B1 | | 1/2001 | Linden et al. |
| 6,272,691 | B1 | | 8/2001 | Henricksen et al. |
| 6,775,846 | B1 | | 8/2004 | LaFauci et al. |

* cited by examiner

*Primary Examiner*—Gloria Hale

(57) ABSTRACT

A garter for items of apparel for providing ornamentation and selectively securing a portion of the item of apparel in a desired position. The garter for items of apparel and method of use includes a band having an engagement means for selectively engaging an item of apparel. The flexible band may be conformable around an extremity of a user.

17 Claims, 6 Drawing Sheets

GARTER FOR ITEMS OF APPAREL AND METHOD OF USE

CROSS REFERENCE TO RELATED APPLICATION

This application is a continuation-in-part of application Ser. No. 10/789,713, filed Feb. 27, 2004, now abandoned which is incorporated by reference herein in its entirety.

BACKGROUND OF THE INVENTION

1. Field of the Invention

The present invention relates to cuff and sleeve retaining devices and more particularly pertains to a new garter for items of apparel and method of use for providing ornamentation to and securing an article of apparel.

2. Description of the Prior Art

The use of cuff and sleeve retaining devices is known in the prior art. Illustrative examples include: U.S. Pat. No. 4,825,475; U.S. Pat. No. 5,787,511; U.S. Pat. No. 6,158,057; U.S. Pat. No. 6,175,961; and U.S. Pat. No. 6,446,268.

While these devices fulfill their respective, particular objectives and requirements, the need remains for a device and method that includes both the capability of providing a decorative accent to an article of apparel, as well as being able to retain a portion of the article of apparel in a selected position.

SUMMARY OF THE INVENTION

The present invention meets the needs presented above by utilizing a variety of engagement means to selectively secure a flexible band around a portion of an article of apparel.

On advantage of the present invention is a pocket member operationally coupled to an interior surface of the flexible member for selectively retaining user accessories.

Another advantage of the present invention is a variety of engagement means for securing the flexible band to the article of apparel without damaging the article of apparel.

To this end, the present invention generally comprises a flexible band having an engagement means for selectively engaging an item of apparel. The flexible band is preferably conformable around an extremity of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
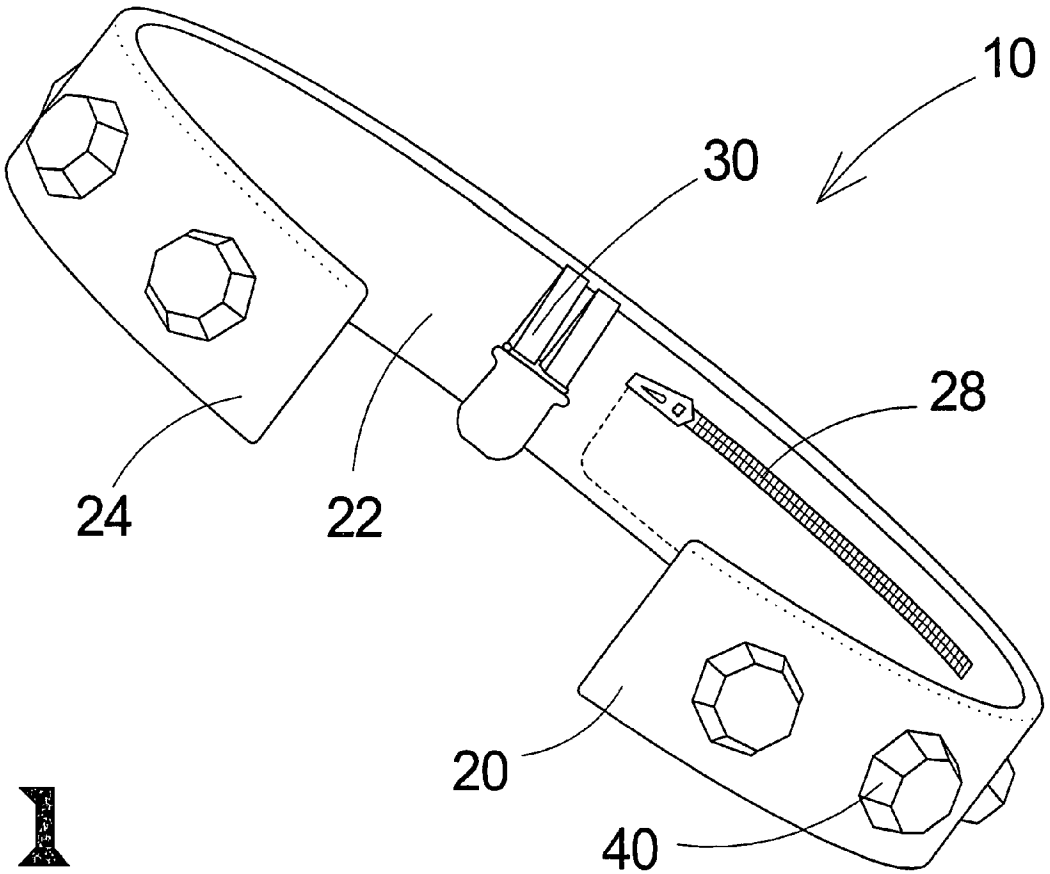
FIG. 1 is a schematic perspective view of a new garter for items of apparel and method of use according to the present invention utilizing a clip engagement means.
Figure 2:
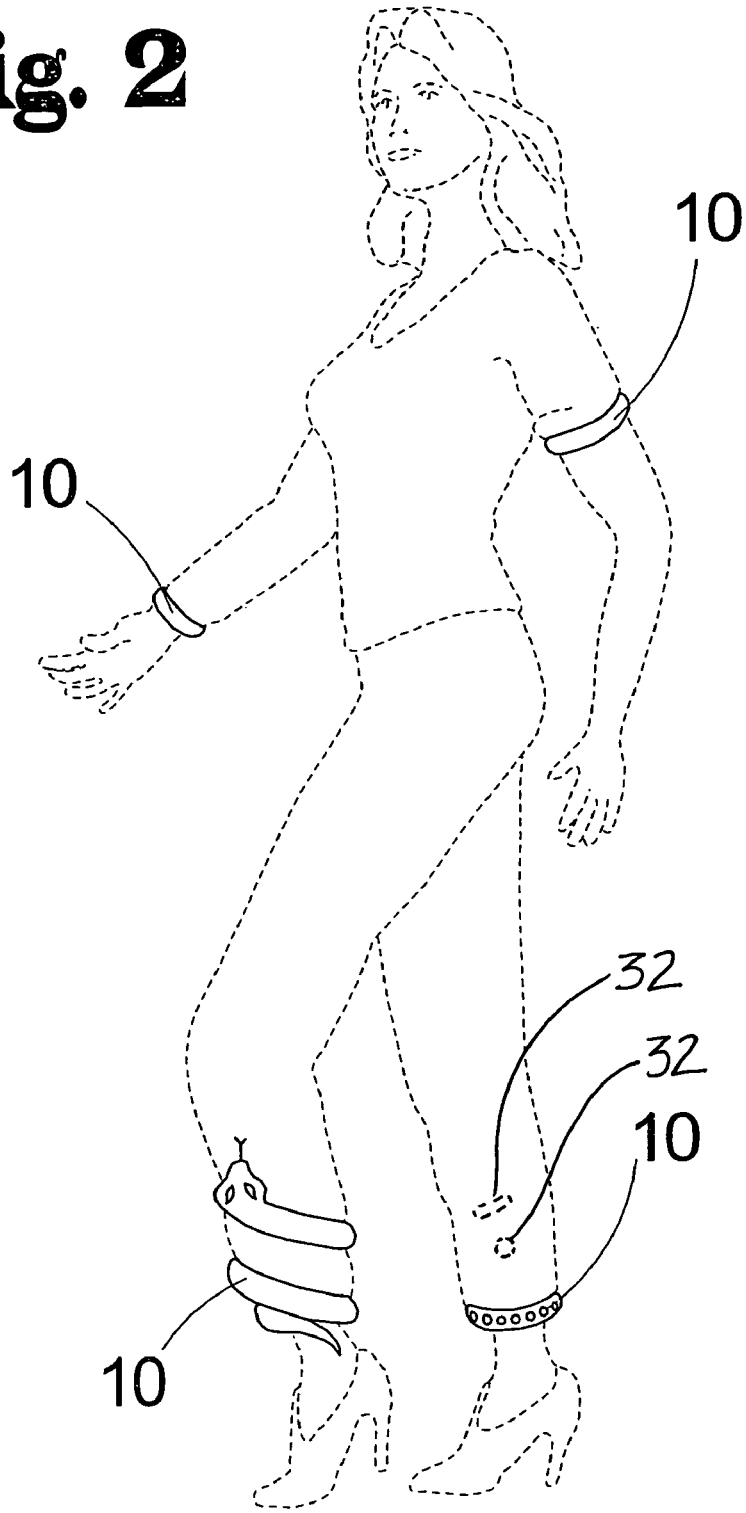
FIG. 2 is a schematic perspective view of the present invention in use.
Figure 3:
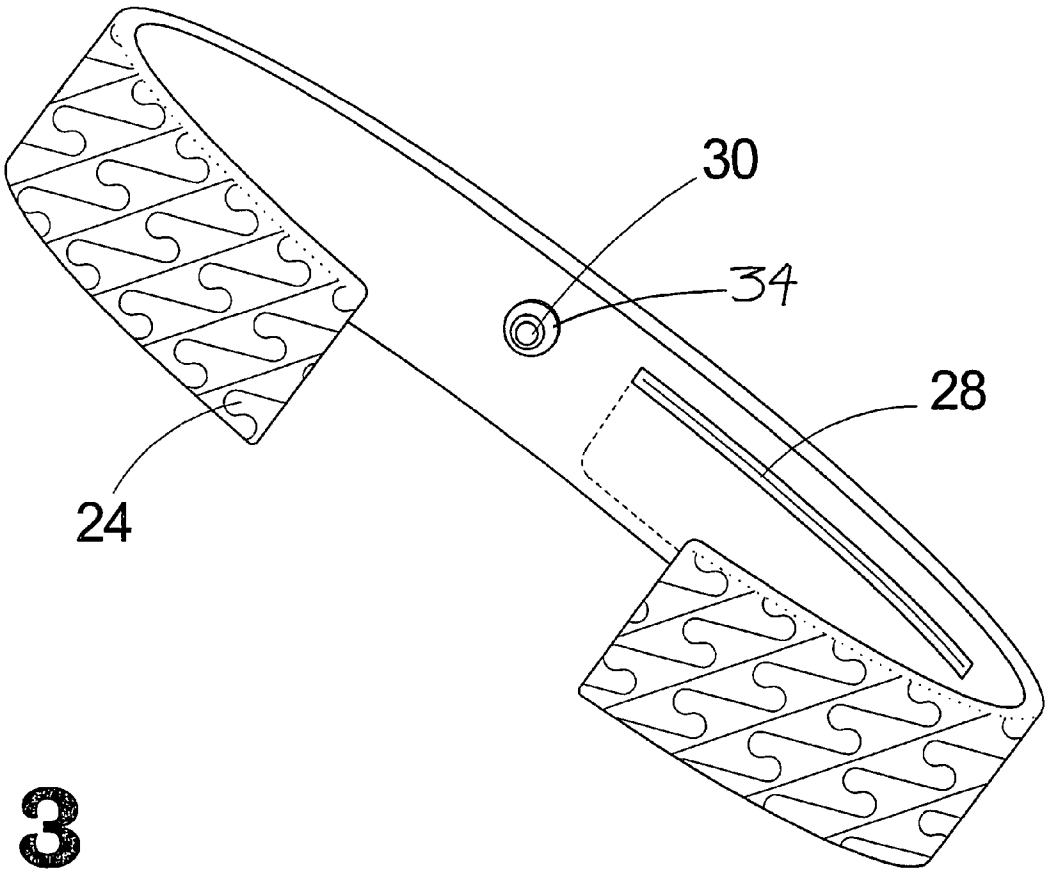
FIG. 3 is a schematic perspective view of the present invention utilizing a snap engagement means.
Figure 4:
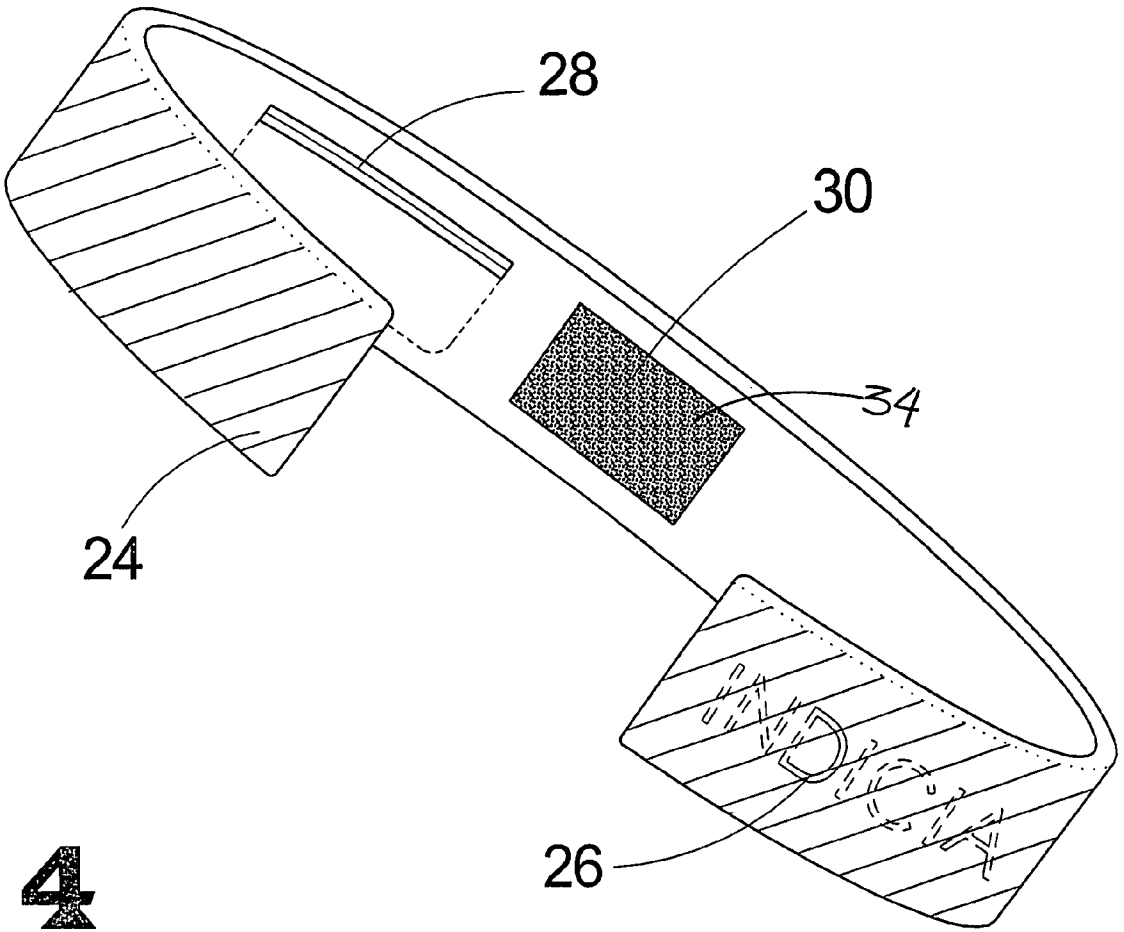
FIG. 4 is a schematic perspective view of the present invention utilizing a hook and loop engagement means.
Figure 5:
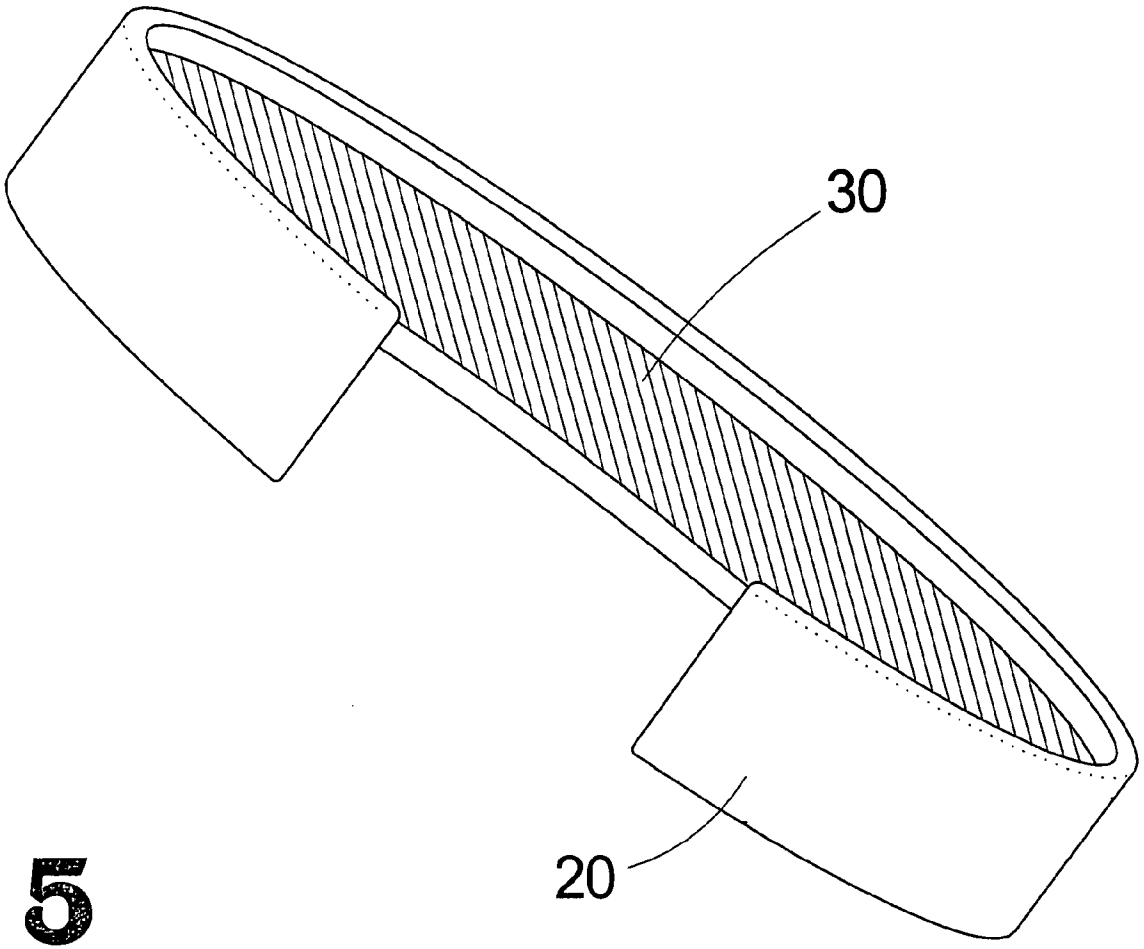
FIG. 5 is a schematic perspective view of the present invention utilizing a velvet engagement means.
Figure 6:
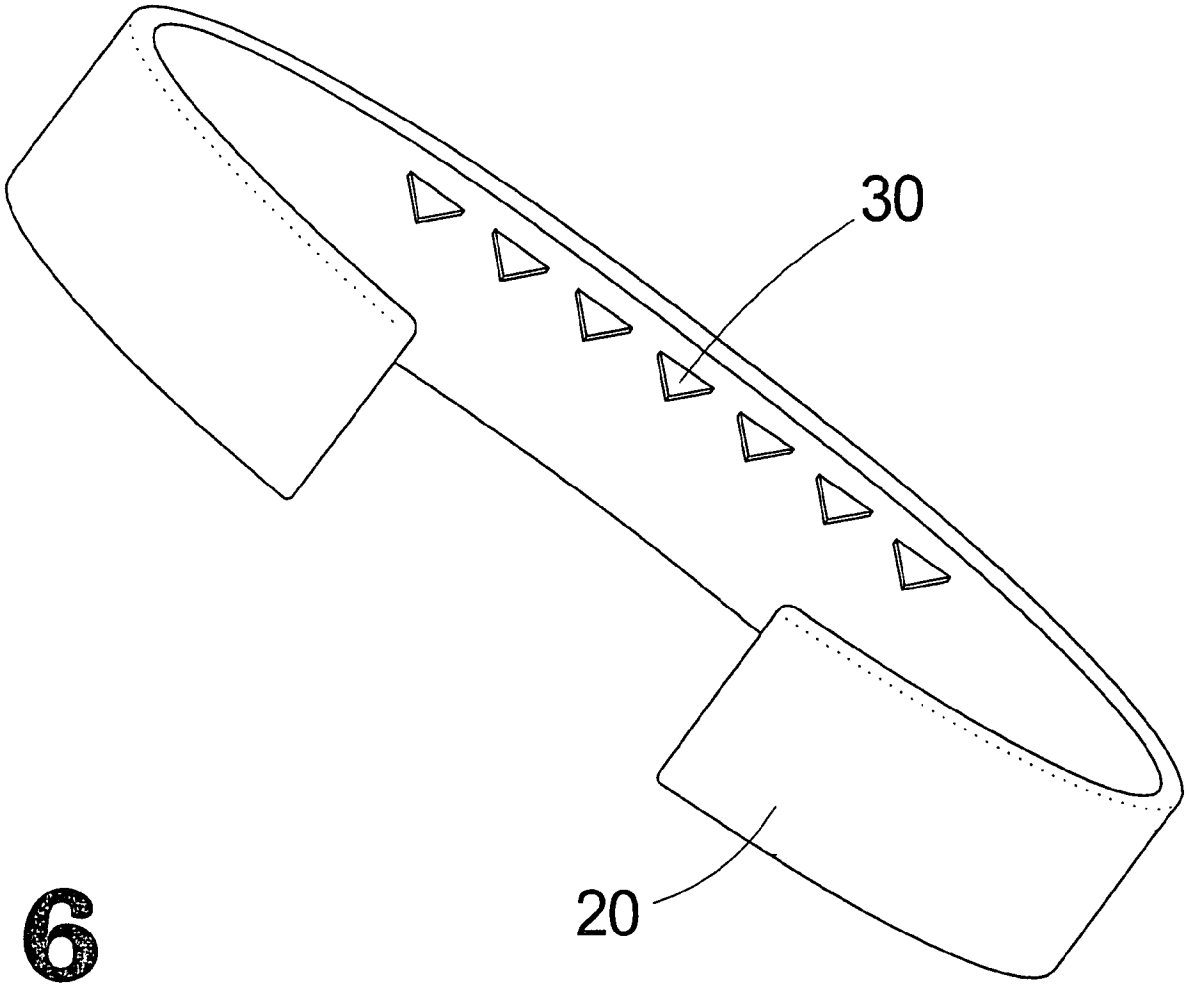
FIG. 6 is a schematic side view of the present invention utilizing a teeth engagement means.

With reference now to the drawings, and in particular to FIGS. 1 through 6 thereof, a new garter for items of apparel and method of use embodying the principles and concepts of the present invention and generally designated by the reference numeral 10 will be described.

As best illustrated in FIGS. 1 through 6, the garter for items of apparel and method of use 10 generally comprises a flexible band 20, and an engagement means 30.

Preferably the flexible band is generally round in shape to facilitate being positioned around an arm or leg of the user. The flexible band has in interior surface 22, which abuts the skin of the user, the item of apparel 2 or both. Additionally, the flexible band has an exterior surface 24 opposite of the interior surface 22. Optionally, the band 20 may be relatively rigid and permit only a small degree of flexing from its typical configuration. As a further option, the band 20 may not form a complete circle, but may include a gap between ends of the band to, for example, permit a portion of the article of apparel to move between the ends The exterior surface 24 may include a decorative design indicia 26, or decorative objects such as rhinestones, gems, or other suitable decorative items. The exterior surface 24 may also include a decorative surface such as leather, gold, silver, or other suitable surface covering.

The engagement means 30 may be selected from a wide range of engagement devices. These devices may include, by way of illustration and not limitation, clips, snaps, hook and loop fasteners, teeth, clasps and velvet. Each of these can be successfully utilized to selectively couple the flexible band 20 to the article of apparel 2. The type of engagement means 30 selected may be determined by both the functional requirement of the flexible band and the material comprising the article of apparel 2. As an illustration, if the flexible band 20 is to be used to hold a denim shirt sleeve up on the forearm or upper arm of the use, either a clip or teeth type device may be used. The clip, such as is shown in FIG. 1, may include two portions that are pivotally coupled together to permit ends of the portions to selectively pinch the material of the article of apparel 2. As another illustration, if the flexible band 20 is to be used as ornamentation around a shirt cuff of a silk shirt, using a velvet lining on the interior surface of the flexible band 20 may be sufficient to retain the flexible band in the desired position without damaging the silk shirt. Some embodiments of the engagement means 30 comprise complementary fasteners. More specifically, a first fastening member 32 may be located on an exterior of the first portion of the article of apparel, and a second fastening member 34 that is complementary to the first fastening member 32 and is located on the interior surface 22 of the band 20 for positioning adjacent to the exterior of the first portion of the article of apparel such that the second fastening member 34 is removably fastenable to the first fastening member 32 and thus the article of apparel. For example, the first and second complementary fasteners may comprise complementary snap fastener portions or complementary hook and loop fastener portions (see FIGS. 2 through 4.

In at least one embodiment, a pocket 28 is coupled to the interior surface 22 of the flexible band 20 for selectively retaining user accessories. Optionally, the open side of the pocket 28 may be positioned in spaced relationship from a longitudinal edge of the flexible band to inhibit (but not completely block) access to the pocket when the band is being worn on and against the article of apparel by the user. Being mounted on the interior surface of the band, the pocket 28 is thus visually obscured from view by the band itself. The pocket 28 may be selectively closed by closure means such as a zipper.

In a further embodiment, at least one illumination member 40, may be operationally coupled to the flexible band 20.

In still a further embodiment, the exterior surface 24 is at least translucent for facilitating visual observation of the at least one illumination member 40.

The flexible member 20 may be formed into a variety of shapes for decorative purposes. One such shape anticipated by the present invention is a snake having multiple coils for wrapping around a pants leg.

The flexible member may have a length sufficient for forming a half, three-quarter, full or multiple circles around the extremity of the user.

In at least one embodiment, the flexible member 20 comprises metal and can be retained in position with a mechanical compression around the extremity of the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for
GARTER FOR ITEMS OF APPAREL AND METHOD OF USE

| | | |
|---|---|---|
| ☐ | | |
| ☐ | | |
| ☐ | 2. | article of apparel |
| ☐ | | |
| ☐ | | |
| ☐ | | |
| ☐ | | |
| ☐ | | |
| ☐ | | |
| ☐ | | |
| ☐ | 10. | GARTER FOR ITEMS OF APPAREL AND |
| ☐ | | METHOD OF USE |
| ☐ | 11. | |
| ☐ | 12. | |
| ☐ | 13. | |
| ☐ | 14. | |
| ☐ | 15. | |
| ☐ | 16. | |
| ☐ | 17. | |
| ☐ | 18. | |
| ☐ | 19. | |

-continued

Index of Elements for
GARTER FOR ITEMS OF APPAREL AND METHOD OF USE

| | | |
|---|---|---|
| ☐ | 20. | FLEXIBLE BAND |
| ☐ | 21. | |
| ☐ | 22. | INTERIOR SURFACE |
| ☐ | 23. | |
| ☐ | 24. | EXTERIOR SURFACE |
| ☐ | 25. | |
| ☐ | 26. | INDICIA |
| ☐ | 27. | |
| ☐ | 28. | POCKET |
| ☐ | 29. | |
| ☐ | 30. | ENGAGEMENT MEANS |
| ☐ | 31. | |
| ☐ | 32. | first complementary fastener |
| ☐ | 33. | |
| ☐ | 34. | second complementary fastener |
| ☐ | 35. | |
| ☐ | 36. | |
| ☐ | 37. | |
| ☐ | 38. | |
| ☐ | 39. | |
| ☐ | 40. | ILLUMINATION MEMBER |
| ☐ | 41. | |
| ☐ | 42. | |
| ☐ | 43. | |
| ☐ | 44. | |
| ☐ | 45. | |
| ☐ | 46. | |
| ☐ | 47. | |
| ☐ | 48. | |
| ☐ | 49. | |
| ☐ | 50. | |
| ☐ | 51. | |
| ☐ | 52. | |
| ☐ | 53. | |
| ☐ | 54. | |
| ☐ | 55. | |
| ☐ | 56. | |
| ☐ | 57. | |
| ☐ | 58. | |
| ☐ | 59. | |
| ☐ | 60. | |
| ☐ | 61. | |
| ☐ | 62. | |
| ☐ | 63. | |
| ☐ | 64. | |
| ☐ | 65. | |
| ☐ | 66. | |
| ☐ | 67. | |
| ☐ | 68. | |
| ☐ | 69. | |
| ☐ | 70. | |
| ☐ | 71. | |
| ☐ | 72. | |
| ☐ | 73. | |
| ☐ | 74. | |
| ☐ | 75. | |
| ☐ | 76. | |
| ☐ | 77. | |
| ☐ | 78. | |
| ☐ | 79. | |

I claim:

1. An accessory system, comprising an article of apparel having a first fastening member located on an exterior of the article of apparel; and an accessory device removably mountable on the article of apparel, the accessory device comprising:

an elongate band being non-continuous and having a pair of opposite ends, the band having an interior surface;

a second fastening member complementary to the first fastening member such that the second fastening member is removably fastenable to the first fastening member, the second fastening member being located on the interior surface of the band to permit positioning of the second fastening member adjacent to the exterior of the article of apparel such that the second fastening member is removably fastenable to the first fastening member and the article of apparel thereon; and at least one illumination member mounted on an exterior of the band;

wherein a gap exists between the ends of the band.

2. The system of claim 1 additionally comprising a pocket positioned on the interior surface of the band for selectively retaining a user accessory, the pocket having an open side for permitting insertion of the user accessory in the pocket through the open side.

3. The system of claim 1 additionally comprising a pocket positioned on the band for selectively retaining a user accessory, the pocket having an open side for permitting insertion of the user accessory in the pocket through the open side; wherein the open side of the pocket is positioned on the interior surface of the band such that the band visually obscures the pocket from view when worn on the article of apparel.

4. The system of claim 1 wherein the band is formed in a generally round shape.

5. The system of claim 1 wherein the band is formed in a generally helical shape along a length of the band such that a portion of the length of the band extends beyond one end of the band.

6. The system of claim 1 wherein the band has an exterior surface opposite the interior surface, the exterior surface including an indicia.

7. The system of claim 1 wherein the first and second fastening members are selected from the group of fastening members consisting of complementary snap portions and complementary hook and loop fastener portions.

8. The system of claim 1 wherein an exterior of the band has a shape of an animal.

9. The system of claim 8 wherein the band has a helical shape, and the exterior of the band has the appearance of a snake to produce a coiled snake appearance.

10. The system of claim 1 wherein the band is substantially rigid.

11. The system of claim 1 wherein the band is flexible so as to be bent around an extremity of a user.

12. The system of claim 1 additionally comprising a pocket positioned on the band for selectively retaining a user accessory, the pocket having an open side for permitting insertion of the user accessory in the pocket through the open side; wherein the open side of the pocket is positioned on the interior surface of the band such that the band visually obscures the pocket from view when worn on the article of apparel;

wherein the band is formed in a generally helical shape along a length of the band such that a portion of the length of the band extends beyond one end of the band and an exterior of the band has the appearance of a snake to produce the appearance of a coiled snake;

wherein the band has an exterior surface opposite the interior surface, the exterior surface including an indicia;

wherein the first and second fastening members are selected from the group of fastening members consisting of complementary snap portions and complementary hook and loop fastener portions; and wherein the band is flexible so as to be bendable around an extremity of a user.

13. A retaining device for an item of apparel comprising:

a flexible band having an interior surface, said flexible band being bendable around an extremity of a user;

a fastening member on the interior surface of said flexible band, said fastening member being capable of selective fastening to a complementary fastening member on an item of apparel;

a pocket positioned on the interior surface of said flexible band such that said flexible band obscures the pocket from view when said flexible band is worn, said pocket selectively retaining a user accessory, said pocket having an open side for permitting insertion of the user accessory in said pocket through said open side;

said flexible band being formed in a generally round shape;

said flexible band having an exterior surface opposite said interior, said exterior surface including an indicia;

at least one illumination member positioned on the exterior surface of the flexible band; and wherein said fastening member is selected from the group of fastening members consisting of a clip or a hook and loop fastener.

14. In combination:

an article of apparel for covering at least a portion of a body of a user, the article having a first portion configured to cover a portion of an extremity of the body of the user, a first fastening member being located on an exterior of the first portion of the article of apparel; and an accessory device removably fastened on the article of apparel, the device comprising:

an elongate band, the band being flexible so as to be bendable around an extremity of a user, the band being non-continuous and having a pair of opposite ends with a gap between the opposite ends, the band having an interior surface;

a second fastening member complementary to the first fastening member, the second fastening member being located on the interior surface of the band for positioning adjacent to the exterior of the first portion of the article of apparel such that the second fastening member is removably fastened to the first fastening member and the article of apparel;

a pocket positioned on the band for selectively retaining a user accessory, the pocket having an open side for permitting insertion of the user accessory in the pocket through the open side, the open side of the pocket being positioned in spaced relationship from a longitudinal edge of the flexible band to inhibit access to the pocket when the band is being worn on the article of the apparel by the user, the pocket being located on the interior surface of the band such that the band visually obscures the open side of the pocket from view when the band is fastened to the article of apparel by the first and second fastening members;

wherein the band has an exterior surface opposite the interior, the exterior surface includes an indicia; and at least one illumination member mounted on the exterior surface of the band.

15. The system of claim 1 wherein the illumination member comprises a plurality of illumination members positioned at spaced locations along the band.

16. The device of claim 13 wherein the illumination member comprises a plurality of illumination members positioned at spaced locations along the band.

17. The combination of claim 14 wherein the illumination member comprises a plurality of illumination members positioned at spaced locations along the band.

* * * * *